US011891747B2

(12) United States Patent
MacDonald, III et al.

(10) Patent No.: US 11,891,747 B2
(45) Date of Patent: Feb. 6, 2024

(54) LAUNDRY APPLIANCE DOOR ASSEMBLY

(71) Applicant: Haier US Appliance Solutions, Inc., Wilmington, DE (US)

(72) Inventors: Robert V. MacDonald, III, Simpsonville, KY (US); Lucius Cole, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 92 days.

(21) Appl. No.: 17/735,305

(22) Filed: May 3, 2022

(65) Prior Publication Data

US 2023/0357979 A1 Nov. 9, 2023

(51) Int. Cl.
*D06F 39/14* (2006.01)
*D06F 37/28* (2006.01)

(52) U.S. Cl.
CPC ..... *D06F 39/14* (2013.01); *D06F 37/28* (2013.01)

(58) Field of Classification Search
CPC ..... D06F 39/14; D06F 37/28
USPC ..... 68/12.26
See application file for complete search history.

(56) References Cited

FOREIGN PATENT DOCUMENTS

| | | | |
|---|---|---|---|
| CN | 108951019 | B | 7/2021 |
| WO | WO2013007507 | A2 | 1/2013 |
| WO | WO2015028240 | A1 | 3/2015 |

OTHER PUBLICATIONS

CN108951019A—Machine translation (Year: 2018).*

* cited by examiner

*Primary Examiner* — Tinsae B Ayalew
(74) *Attorney, Agent, or Firm* — Dority & Manning, P.A.

(57) ABSTRACT

A laundry appliance includes a cabinet that defines an opening. The laundry appliance also includes a vessel mounted within the cabinet and accessible through the opening. The laundry appliance further includes a door assembly rotatably mounted to the cabinet at the opening. The door assembly includes a frame and a window in the frame. The door assembly further includes a shield outbound of the window. The shield includes a first plurality of locking tabs spaced around an outer circumference of the shield. The door assembly also includes a trim ring surrounding the shield. The trim ring includes a second plurality of locking tabs spaced around an inner circumference of the trim ring. The shield and the trim ring are coupled together by mutual engagement of the first plurality of locking tabs and the second plurality of locking tabs.

18 Claims, 15 Drawing Sheets

LAUNDRY APPLIANCE DOOR ASSEMBLY

FIELD OF THE INVENTION

The present subject matter relates generally to laundry appliances, such as washing machine appliances and dryer appliances, and in particular to door assemblies for such appliances.

BACKGROUND OF THE INVENTION

Laundry appliances, such as washing machine appliances and dryer appliances, generally include a rotatable vessel therein. For example, washing machine appliances generally include a tub for containing water or wash fluid, e.g., water and detergent, bleach, and/or other wash additives. A basket is rotatably mounted within the tub and defines a wash chamber for receipt of articles for washing. During normal operation of such washing machine appliances, the wash fluid is directed into the tub and onto articles within the wash chamber of the basket. The basket can rotate at various speeds to agitate articles within the wash chamber, to wring wash fluid from articles within the wash chamber, etc. As another example, the rotatable vessel may be a drum of a clothes dryer appliance. A conventional appliance for drying articles such as a clothes dryer (or laundry dryer) for drying clothing articles typically includes a cabinet having a rotating drum for tumbling clothes and laundry articles therein. One or more heating elements heat air prior to the air entering the drum, and the warm air is circulated through the drum as the clothes are tumbled to remove moisture from laundry articles in the drum. Gas or electric heating elements may be used to heat the air that is circulated through the drum.

Such laundry appliances also typically include a lid or a door to provide selective access to the interior of the laundry appliance, such as to the vessel, e.g., wash tub or drum, therein. The lid or door may include a window or other aperture. In such cases, the window may become smudged or scratched over time. Also, the window may become hot to the touch during certain laundry appliance operations, e.g., in a wash cycle using hot water in a washing machine appliance, a dry cycle using high heat in a dryer appliance, or a steam clean or sanitizing cycle in any laundry appliance.

Thus, a laundry appliance which includes features for preventing direct access to a window in the lid or door would be beneficial.

BRIEF DESCRIPTION OF THE INVENTION

Aspects and advantages of the invention will be set forth in part in the following description, or may be obvious from the description, or may be learned through practice of the invention.

In accordance with one embodiment of the present disclosure, a laundry appliance is provided. The laundry appliance includes a cabinet. The cabinet defines an opening. The laundry appliance also includes a vessel mounted within the cabinet. The vessel is accessible through the opening. The laundry appliance further includes a door assembly rotatably mounted to the cabinet at the opening. The door assembly is rotatable between a closed position wherein the vessel is enclosed within the cabinet and an open position permitting access to the vessel through the opening. The door assembly includes a frame and a window in the frame. The door assembly further includes a shield outbound of the window. The shield includes a first plurality of locking tabs spaced around an outer circumference of the shield. The door assembly also includes a trim ring surrounding the shield. The trim ring includes a second plurality of locking tabs spaced around an inner circumference of the trim ring. The shield and the trim ring are coupled together by mutual engagement of the first plurality of locking tabs and the second plurality of locking tabs.

In accordance with another embodiment of the present disclosure, a laundry appliance is provided. The laundry appliance includes a cabinet. The cabinet defines an opening. The laundry appliance also includes a vessel mounted within the cabinet. The vessel is accessible through the opening. The laundry appliance further includes a door assembly rotatably mounted to the cabinet at the opening. The door assembly is rotatable between a closed position wherein the vessel is enclosed within the cabinet and an open position permitting access to the vessel through the opening. The door assembly includes a frame and a window in the frame. The door assembly further includes a shield outbound of the window. The shield includes a first circumferential locking tab. The door assembly also includes a trim ring surrounding the shield. The trim ring includes a second circumferential locking tab, the shield and the trim ring coupled together by mutual engagement of the first circumferential locking tab and the second circumferential locking tab.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
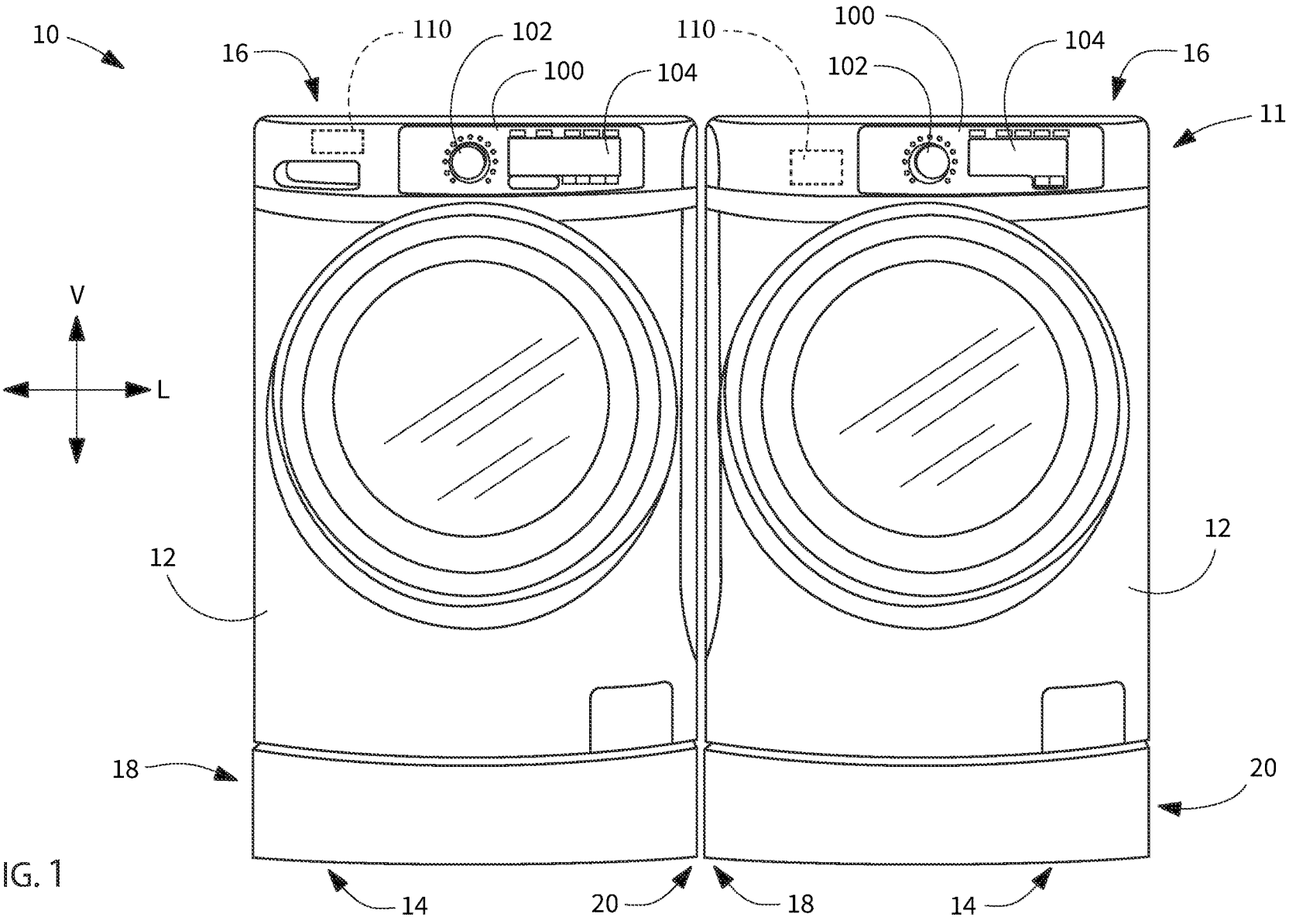
FIG. 1 provides a front view of an exemplary washing machine appliance and an exemplary dryer appliance in accordance with one or more exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, terms of approximation, such as "generally," or "about" include values within ten percent greater or less than the stated value. When used in the context of an angle or direction, such terms include within ten degrees greater or less than the stated angle or direction. For example, "generally vertical" includes directions within ten degrees of vertical in any direction, e.g., clockwise or counter-clockwise.

Figure 2:
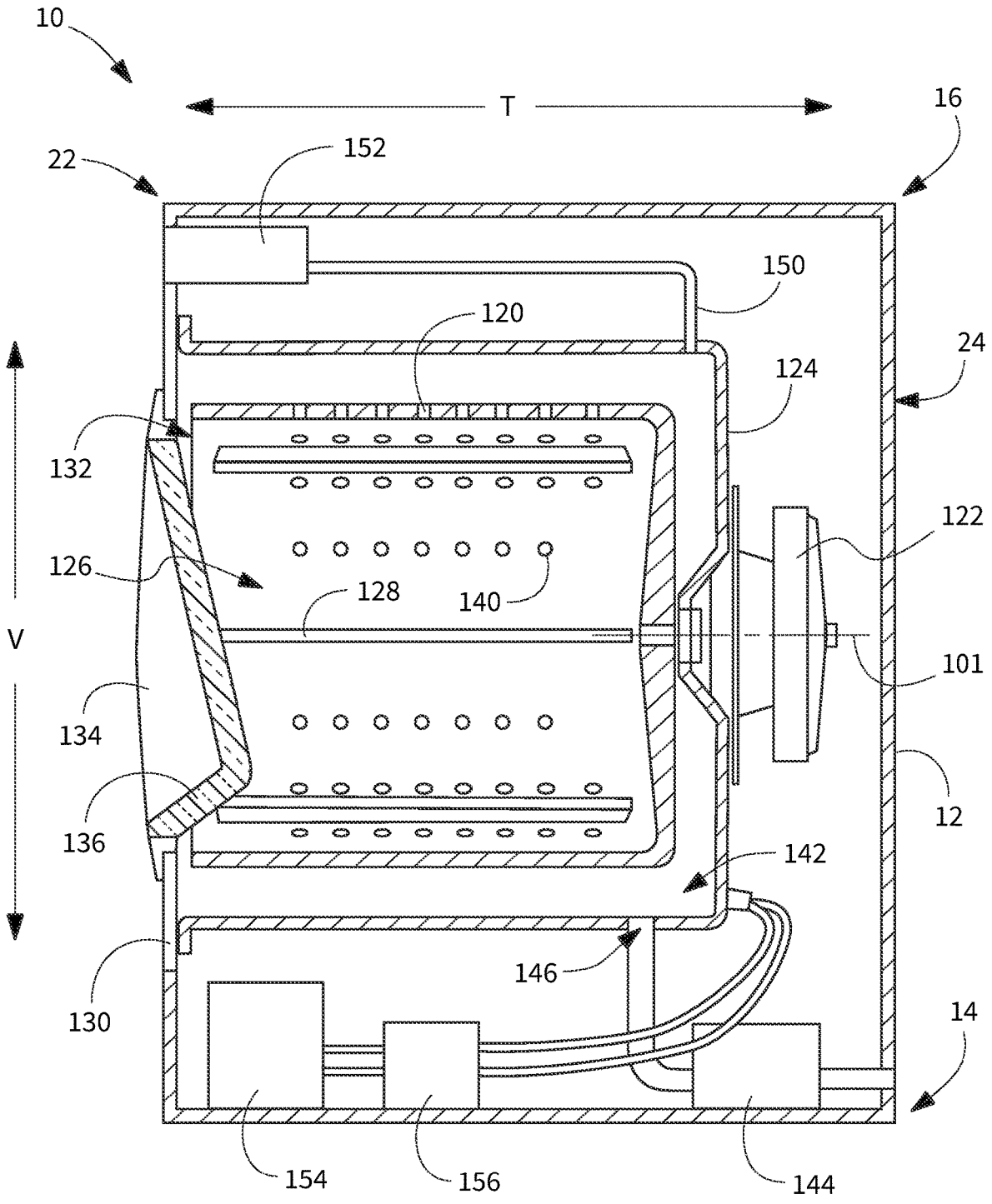
FIG. 2 provides a transverse cross-sectional view of the exemplary washing machine appliance of FIG. 1.
Figure 3:
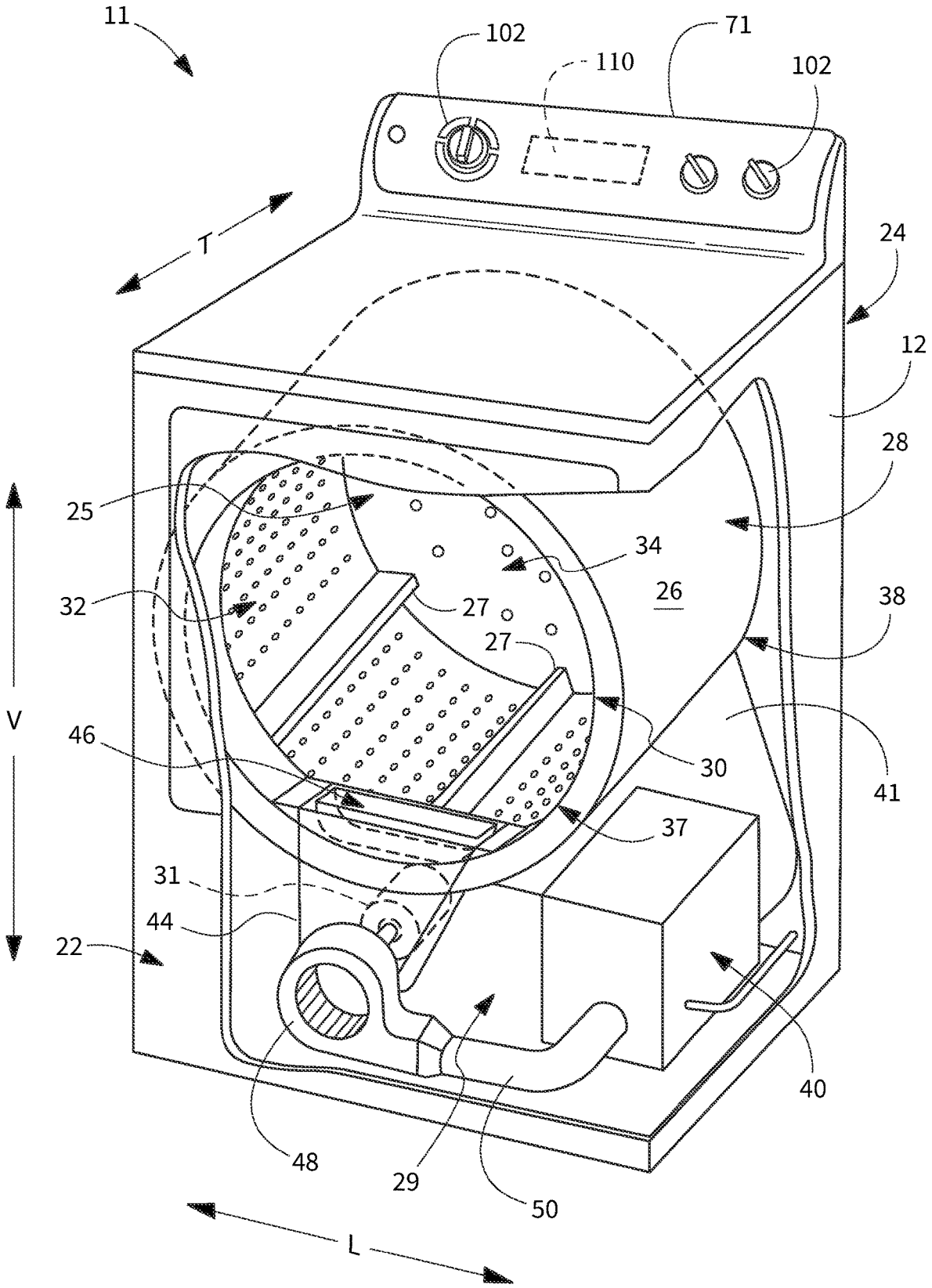
FIG. 3 provides a perspective view of the exemplary dryer appliance of FIG. 1 with portions of a cabinet of the dryer appliance removed to reveal certain components of the dryer appliance.

Exemplary laundry appliances are illustrated in FIGS. 1 through 3, e.g., a washing machine appliance and a dryer appliance. In various embodiments of the present subject matter, a laundry appliance may be any suitable laundry appliance, such as a washing machine appliance, a dryer appliance, a combination washer-dryer appliance, etc.

As may be seen generally throughout FIGS. 1 through 3, a user interface panel 100 and a user input device 102 may be positioned on an exterior of the laundry appliance. The user input device 102 is generally positioned proximate to the user interface panel 100, and in some embodiments, the user input device 102 may be positioned on the user interface panel 100.

In various embodiments, the user interface panel 100 may represent a general purpose I/O ("GPIO") device or functional block. In some embodiments, the user interface panel 100 may include or be in operative communication with user input device 102, such as one or more of a variety of digital, analog, electrical, mechanical or electro-mechanical input devices including rotary dials, control knobs, push buttons, and touch pads. The user interface panel 100 may include a display component 104, such as a digital or analog display device designed to provide operational feedback to a user. The display component 104 may also be a touchscreen capable of receiving a user input, such that the display component 104 may also be a user input device in addition to or instead of the user input device 102.

Generally, each appliance may include a controller 110 in operative communication with the user input device 102. The user interface panel 100 and the user input device 102 may be in communication with the controller 110 via, for example, one or more signal lines or shared communication busses. Input/output ("I/O") signals may be routed between controller 110 and various operational components of the appliance. Operation of the appliance can be regulated by the controller 110 that is operatively coupled to the user interface panel 100. A user interface panel 100 may for example provide selections for user manipulation of the operation of an appliance, e.g., via user input device 102 and/or display 104. In response to user manipulation of the user interface panel 100 and/or user input device 102, the controller 110 may operate various components of the appliance. Controller 110 may include a memory and one or more microprocessors, CPUs or the like, such as general or special purpose microprocessors operable to execute programming instructions or micro-control code associated with operation of the appliance. The memory may represent random access memory such as DRAM, or read only memory such as ROM or FLASH. In one embodiment, the processor executes programming instructions stored in memory. The memory may be a separate component from the processor or may be included onboard within the processor. Alternatively, a controller 110 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

The controller 110 may be programmed to operate the appliance by executing instructions stored in memory. For example, the instructions may be software or any set of instructions that when executed by the processing device, cause the processing device to perform operations. Controller 110 can include one or more processor(s) and associated memory device(s) configured to perform a variety of computer-implemented functions and/or instructions (e.g. performing the methods, steps, calculations and the like and storing relevant data as disclosed herein). It should be noted that controllers 110 as disclosed herein are capable of and may be operable to perform any methods and associated method steps as disclosed herein.

In some embodiments, for example, as illustrated in FIG. 1, a laundry appliance may be a washing machine appliance 10 or a dryer appliance 11, and a group of laundry appliances may include multiple washing machine appliances 10 or multiple dryer appliances 11. In embodiments such as illustrated in FIG. 1, the user input device 102 of each appliance 10 and 11 may be positioned on the user interface panel 100. The embodiment illustrated in FIG. 1 also includes a display 104 on the user interface panel 100 of each laundry appliance 10 and 11.

As generally seen throughout FIGS. 1 through 3, in at least some embodiments, each laundry appliance 10 and 11 includes a cabinet 12 which defines a vertical direction V, a lateral direction L, and a transverse direction T that are mutually perpendicular. Each cabinet 12 extends between a top side 16 and a bottom side 14 along the vertical direction V. Each cabinet 12 also extends between a left side 18 and a right side 20, e.g., along the lateral direction L, and between a front side 22 and a rear side 24 along the transverse direction T.

Additional exemplary details of each laundry appliance are illustrated in FIGS. 2 and 3. For example, FIG. 2 provides a cross-sectional view of the exemplary washing machine appliance 10. As illustrated in FIG. 2, a wash tub 124 is non-rotatably mounted within cabinet 12. As may be seen in FIG. 2, the wash tub 124 defines a central axis 101. In the example embodiment illustrated by FIG. 2, the central axis 101 may be oriented generally along or parallel to the transverse direction T of the washing machine appliance 10. Accordingly, the washing machine appliance 10 may be referred to as a horizontal axis washing machine.

Referring again to FIG. 2, a wash basket 120 is rotatably mounted within the tub 124 such that the wash basket 120 is rotatable about an axis of rotation, which generally coincides with central axis 101 of the tub 124. A motor 122, e.g., such as a pancake motor, is in mechanical communication with wash basket 120 to selectively rotate wash basket 120 (e.g., during an agitation or a rinse cycle of washing machine appliance 10). Wash basket 120 defines a wash chamber 126 that is configured for receipt of articles for washing. The wash tub 124 holds wash and rinse fluids for agitation in wash basket 120 within wash tub 124. As used herein, "wash fluid" may refer to water, detergent, fabric softener, bleach, or any other suitable wash additive or combination thereof. The wash basket 120 and the tub 124 may collectively define at least a portion of a tub assembly for the washing machine appliance 10.

Wash basket 120 may define one or more agitator features that extend into wash chamber 126 to assist in agitation and cleaning of articles disposed within wash chamber 126 during operation of washing machine appliance 10. For example, as illustrated in FIG. 2, a plurality of ribs 128 extends from basket 120 into wash chamber 126. In this manner, for example, ribs 128 may lift articles disposed in wash basket 120 during rotation of wash basket 120.

Referring generally to FIGS. 1 and 2, cabinet 12 also includes a front panel 130 which defines an opening 132 that permits user access to wash basket 120 within wash tub 124. More specifically, washing machine appliance 10 includes a door 134 that is positioned in front of opening 132 and is rotatably mounted to front panel 130. Door 134 is rotatable such that door 134 permits selective access to opening 132 by rotating between an open position (not shown) facilitating access to a wash tub 124 and a closed position (FIG. 1) prohibiting access to wash tub 124.

A window 136 in door 134 permits viewing of wash basket 120 when door 134 is in the closed position, e.g., during operation of washing machine appliance 10. Door 134 also includes a handle (not shown) that, e.g., a user may pull when opening and closing door 134. Further, although door 134 is illustrated as mounted to front panel 130, it should be appreciated that door 134 may be mounted to another side of cabinet 12 or any other suitable support according to alternative embodiments.

Referring again to FIG. 2, wash basket 120 also defines a plurality of perforations 140 in order to facilitate fluid communication between an interior of basket 120 and wash tub 124. A sump 142 is defined by wash tub 124 at a bottom of wash tub 124 along the vertical direction V. Thus, sump 142 is configured for receipt of and generally collects wash fluid during operation of washing machine appliance 10. For example, during operation of washing machine appliance 10, wash fluid may be urged by gravity from basket 120 to sump 142 through plurality of perforations 140. A pump assembly 144 is located beneath tub 124 for gravity assisted flow when draining tub 124, e.g., via a drain 146. Pump assembly 144 may be configured for recirculating wash fluid within wash tub 124.

A spout 150 is configured for directing a flow of fluid into wash tub 124. For example, spout 150 may be in fluid communication with a water supply (not shown) in order to direct fluid (e.g., clean water) into wash tub 124. Spout 150 may also be in fluid communication with the sump 142. For example, pump assembly 144 may direct wash fluid disposed in sump 142 to spout 150 in order to circulate wash fluid in wash tub 124.

As illustrated in FIG. 2, a detergent drawer 152 is slidably mounted within front panel 130. Detergent drawer 152 receives a wash additive (e.g., detergent, fabric softener, bleach, or any other suitable liquid or powder) and directs the fluid additive to wash chamber 124 during operation of washing machine appliance 10. According to the illustrated embodiment, detergent drawer 152 may also be fluidly coupled to spout 150 to facilitate the complete and accurate dispensing of wash additive.

Additionally, a bulk reservoir 154 is disposed within cabinet 12. Bulk reservoir 154 is also configured for receipt of fluid additive for use during operation of washing machine appliance 10. Bulk reservoir 154 is sized such that a volume of fluid additive sufficient for a plurality or multitude of wash cycles of washing machine appliance 10 (e.g., five, ten, twenty, fifty, or any other suitable number of wash cycles) may fill bulk reservoir 154. Thus, for example, a user can fill bulk reservoir 154 with fluid additive and operate washing machine appliance 10 for a plurality of wash cycles without refilling bulk reservoir 154 with fluid additive. A reservoir pump 156 is configured for selective delivery of the fluid additive from bulk reservoir 154 to wash tub 124.

During operation of washing machine appliance 10, e.g., during a wash cycle of the washing machine appliance 10, a laundry items are loaded into wash basket 120 through opening 132, and washing operation is initiated through operator manipulation of input selectors 102. Wash tub 124 is filled with water, detergent, and/or other fluid additives, e.g., via spout 150 and/or detergent drawer 152. One or more valves (not shown) can be controlled by washing machine appliance 10 to provide for filling wash basket 120 to the appropriate level for the amount of articles being washed and/or rinsed. By way of example for a wash mode, once wash basket 120 is properly filled with fluid, the contents of wash basket 120 can be agitated (e.g., with ribs 128) for washing of laundry items in wash basket 120.

After the agitation phase of the wash cycle is completed, wash tub 124 can be drained. Laundry articles can then be rinsed by again adding fluid to wash tub 124, depending on the particulars of the cleaning cycle selected by a user. Ribs 128 may again provide agitation within wash basket 120. One or more spin cycles may also be used. In particular, a spin cycle may be applied after the wash cycle and/or after the rinse cycle in order to wring wash fluid from the articles being washed. During a spin cycle, basket 120 is rotated at relatively high speeds. After articles disposed in wash basket 120 are cleaned and/or washed, the user can remove the articles from wash basket 120, e.g., by opening door 134 and reaching into wash basket 120 through opening 132.

While described in the context of a specific embodiment of horizontal axis washing machine appliance 10, using the teachings disclosed herein it will be understood that horizontal axis washing machine appliance 10 is provided by way of example only. It should be appreciated that the present subject matter is not limited to any particular style, model, or configuration of washing machine appliance. Other washing machine appliances having different configurations, different appearances, and/or different features may also be utilized with the present subject matter as well, e.g., vertical axis washing machine appliances.

FIG. 3 provides a perspective view of the dryer appliance 11 of FIG. 1, which is an example embodiment of a laundry appliance, with a portion of a cabinet or housing 12 of dryer appliance 11 removed in order to show certain components of dryer appliance 11. Dryer appliance 11 generally defines a vertical direction V, a lateral direction L, and a transverse direction T, each of which is mutually perpendicular, such that an orthogonal coordinate system is defined. While described in the context of a specific embodiment of dryer appliance 11, using the teachings disclosed herein, it will be understood that dryer appliance 11 is provided by way of example only. Other dryer appliances having different appearances and different features may also be utilized with the present subject matter as well.

Cabinet 12 includes a front side 22 and a rear side 24 spaced apart from each other along the transverse direction T. Within cabinet 12, an interior volume 29 is defined. A drum or container 26 is mounted for rotation about a substantially horizontal axis within the interior volume 29. Drum 26 defines a chamber 25 for receipt of articles of clothing for tumbling and/or drying. Drum 26 extends between a front portion 37 and a back portion 38. Drum 26 also includes a back or rear wall 34, e.g., at back portion 38 of drum 26. A supply duct 41 may be mounted to rear wall 34 and receives heated air that has been heated by a heating assembly or system 40.

As used herein, the terms "clothing" or "articles" includes but need not be limited to fabrics, textiles, garments, linens, papers, or other items from which the extraction of moisture is desirable. Furthermore, the term "load" or "laundry load" refers to the combination of clothing that may be washed together in a washing machine or dried together in a dryer appliance 11 (e.g., clothes dryer) and may include a mixture of different or similar articles of clothing of different or similar types and kinds of fabrics, textiles, garments and linens within a particular laundering process.

A motor 31 is provided in some embodiments to rotate drum 26 about the horizontal axis, e.g., via a pulley and a belt (not pictured). Drum 26 is generally cylindrical in shape, having an outer cylindrical wall 28 and a front flange or wall 30 that defines an opening 32 of drum 26, e.g., at front portion 37 of drum 26, for loading and unloading of articles into and out of chamber 25 of drum 26. A plurality of lifters or baffles 27 are provided within chamber 25 of drum 26 to lift articles therein and then allow such articles to tumble back to a bottom of drum 26 as drum 26 rotates. Baffles 27 may be mounted to drum 26 such that baffles 27 rotate with drum 26 during operation of dryer appliance 11.

The rear wall 34 of drum 26 may be rotatably supported within the cabinet 12 by a suitable fixed bearing. Rear wall 34 can be fixed or can be rotatable. Rear wall 34 may include, for instance, a plurality of holes that receive hot air that has been heated by heating system 40. The heating system 40 may include, e.g., a heat pump, an electric heating element, and/or a gas heating element (e.g., gas burner). Moisture laden, heated air is drawn from drum 26 by an air handler, such as blower fan 48, which generates a negative air pressure within drum 26. The moisture laden heated air passes through a duct 44 enclosing screen filter 46, which traps lint particles. As the air passes from blower fan 48, it enters a duct 50 and then is passed into heating system 40. In some embodiments, the dryer appliance 11 may be a conventional dryer appliance, e.g., the heating system 40 may be or include an electric heating element, e.g., a resistive heating element, or a gas-powered heating element, e.g., a gas burner. In other embodiments, the dryer appliance may be a condensation dryer, such as a heat pump dryer. In such embodiments, heating system 40 may be or include a heat pump including a sealed refrigerant circuit. Heated air (with a lower moisture content than was received from drum 26), exits heating system 40 and returns to drum 26 by duct 41. After the clothing articles have been dried, they are removed from the drum 26 via opening 32. A door (FIG. 1) provides for closing or accessing drum 26 through opening 32.

In some embodiments, one or more selector inputs 102, such as knobs, buttons, touchscreen interfaces, etc., may be provided or mounted on the cabinet 12 (e.g., on a backsplash 71) and are in operable communication (e.g., electrically coupled or coupled through a wireless network band) with the processing device or controller 110. Controller 110 may also be provided in operable communication with components of the dryer appliance 11 including motor 31, blower 48, or heating system 40. In turn, signals generated in controller 110 direct operation of motor 31, blower 48, or heating system 40 in response to the position of inputs 102. As used herein, "processing device" or "controller" may refer to one or more microprocessors, microcontroller, ASICS, or semiconductor devices and is not restricted necessarily to a single element. The controller 110 may be programmed to operate dryer appliance 11 by executing instructions stored in memory (e.g., non-transitory media). The controller 110 may include, or be associated with, one or more memory elements such as RAM, ROM, or electrically erasable, programmable read only memory (EEPROM). For example, the instructions may be software or any set of instructions that when executed by the processing device, cause the processing device to perform operations. It should be noted that controllers as disclosed herein are capable of and may be operable to perform any methods and associated method steps as disclosed herein. For example, in some embodiments, methods disclosed herein may be embodied in programming instructions stored in the memory and executed by the controller 110.

Figure 4:
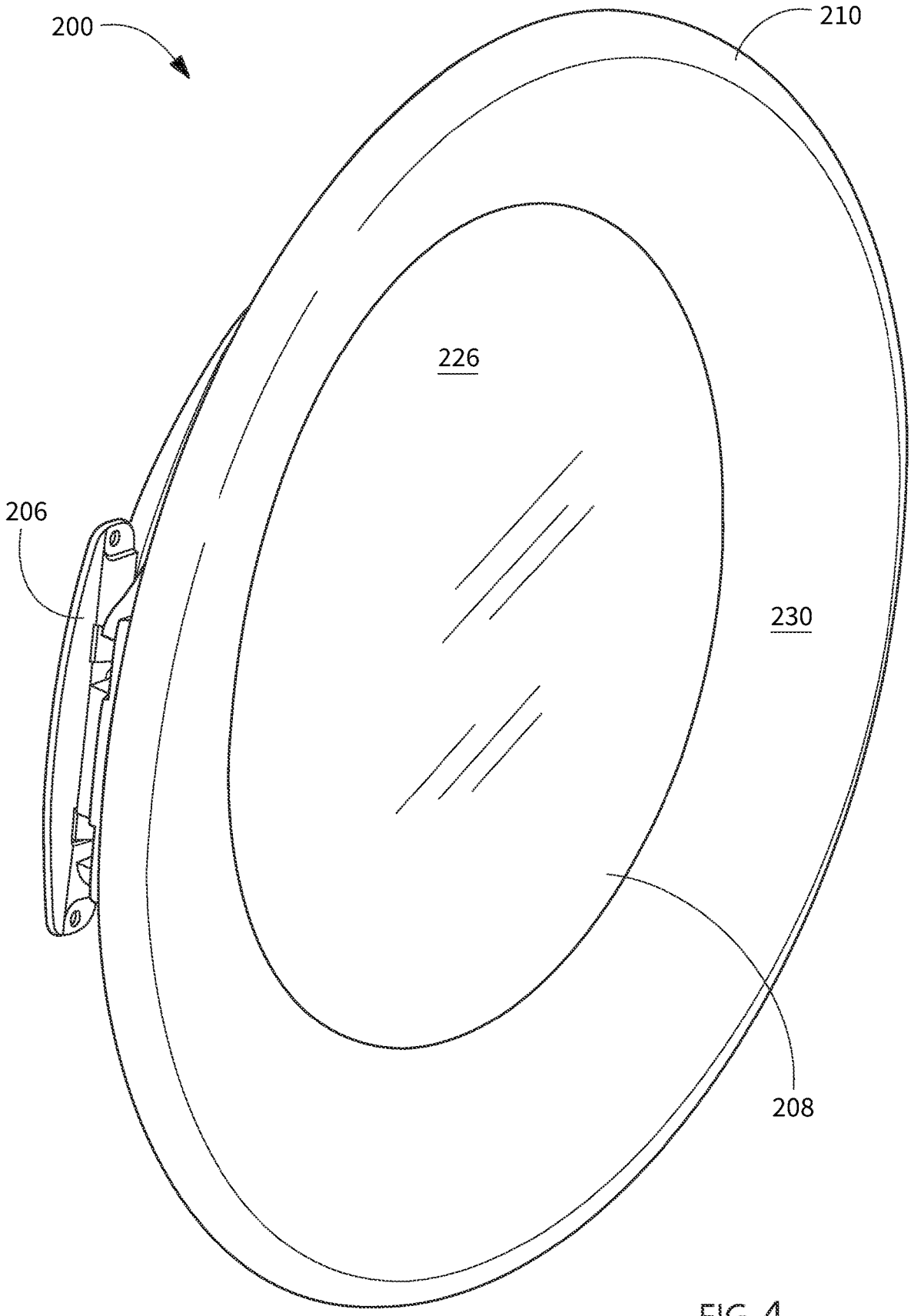
FIG. 4 provides a perspective view of a door assembly according to one or more embodiments of the present disclosure which may be incorporated in a laundry appliance such as one of the exemplary laundry appliances illustrated in FIGS. 1 through 3.
Figure 5:
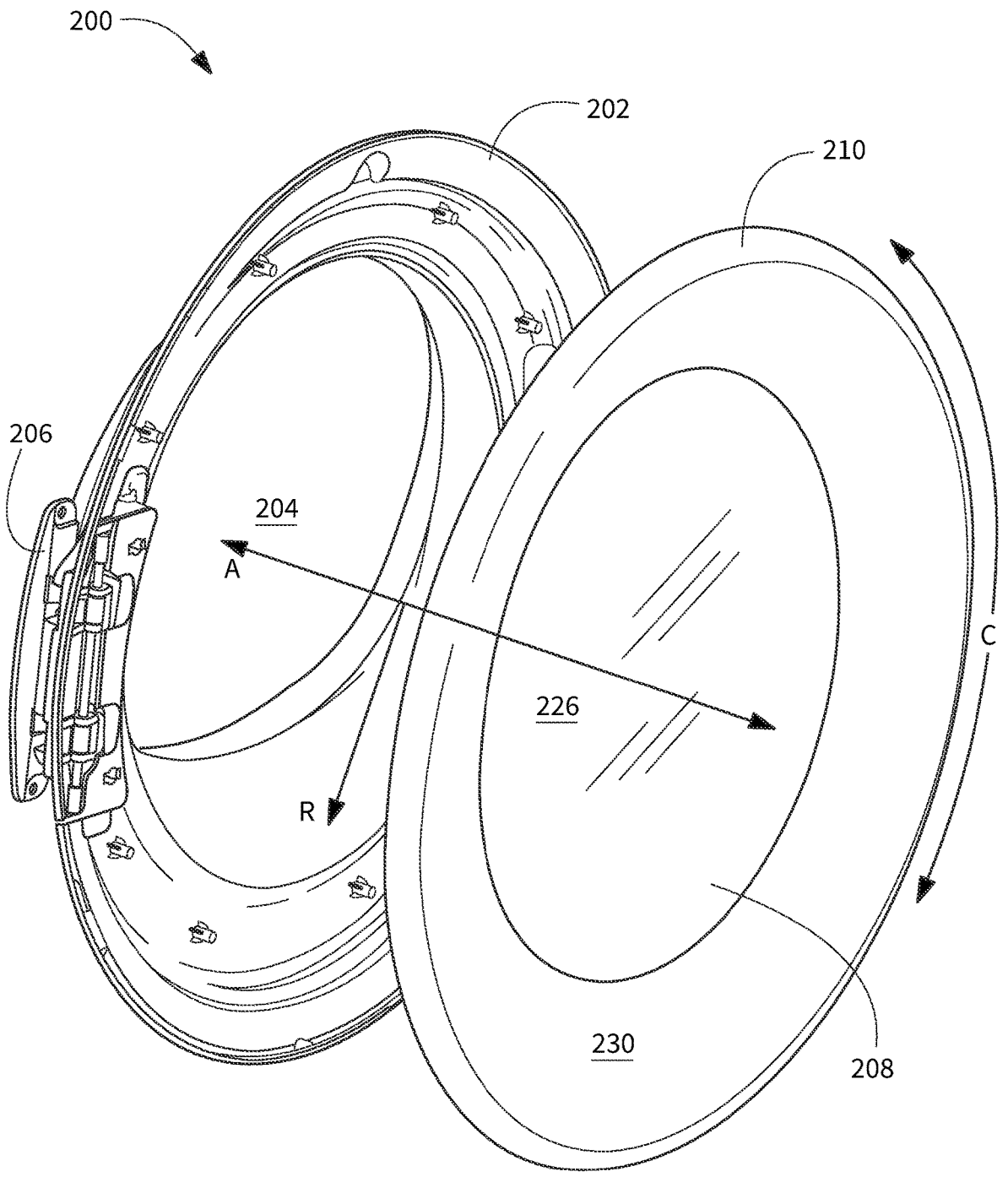
FIG. 5 provides an exploded perspective view of the door assembly of FIG. 4.

Turning now to FIG. 4, a perspective view of a door assembly 200 of a laundry appliance is provided. FIG. 5 provides a partially exploded view of the door assembly 200, e.g., with a shield 208 and trim ring 210 separated from the remainder of the door assembly 200. Door assembly 200 may be used with any laundry appliance, such as but not limited to, the washing machine appliance 10 or the dryer appliance 11 described above. Thus, the door assembly 200 may be an embodiment of door 134 for washing machine appliance 10, or used in place of door 134, or may be a door for a dryer appliance, such as dryer appliance 11, among other possibilities within the scope of the present disclosure.

As may be seen in FIG. 5 in particular, the door assembly 200 may define an axial direction A. For example, the axial direction A may extend through the geometric center of the door assembly 200 and may extend from the interior of the laundry appliance to the exterior of the laundry appliance. For example, the axial direction A may be generally parallel to the transverse direction T in some embodiments, e.g., as in the illustrated embodiments wherein the laundry appliance is a front-load laundry appliance. In other embodiments, the axial direction A may have a different orientation, such as generally parallel to the vertical direction V in top-load embodiments. Also as may be seen, e.g., in FIG. 5, the door assembly 200 may further define a radial direction R perpendicular to the axial direction A and a circumferential direction C that extends around the axial direction A.

As may be seen in FIGS. 4 and 5, door assembly 200 may, in some exemplary embodiments, include a frame 202 with a window 204 in the frame 202. The window 204 and frame 202 may define an inner portion of the door assembly 200, e.g., may be positioned closest to the interior of the laundry appliance, such as when the door assembly 200 is in the closed position, relative to the other portions of the door assembly 200, such as a shield 208 and trim ring 210, e.g., the shield 208 may be positioned outboard, e.g., along the axial direction A, such as closer to the exterior of the laundry appliance and facing away from the interior of the laundry appliance, of the window 204, whereby the shield 208 may protect the window 204, e.g., from scratches or smudges, and may prevent a user from touching the window 204, e.g., when the window 204 becomes hot, such as in embodiments where the laundry appliance is a dryer appliance and/or includes a steam clean or other high-temperature operation. The door assembly 200 may be mountable to the cabinet of the laundry appliance, such as rotatably mountable to the cabinet, by a hinge 206.

Figure 6:
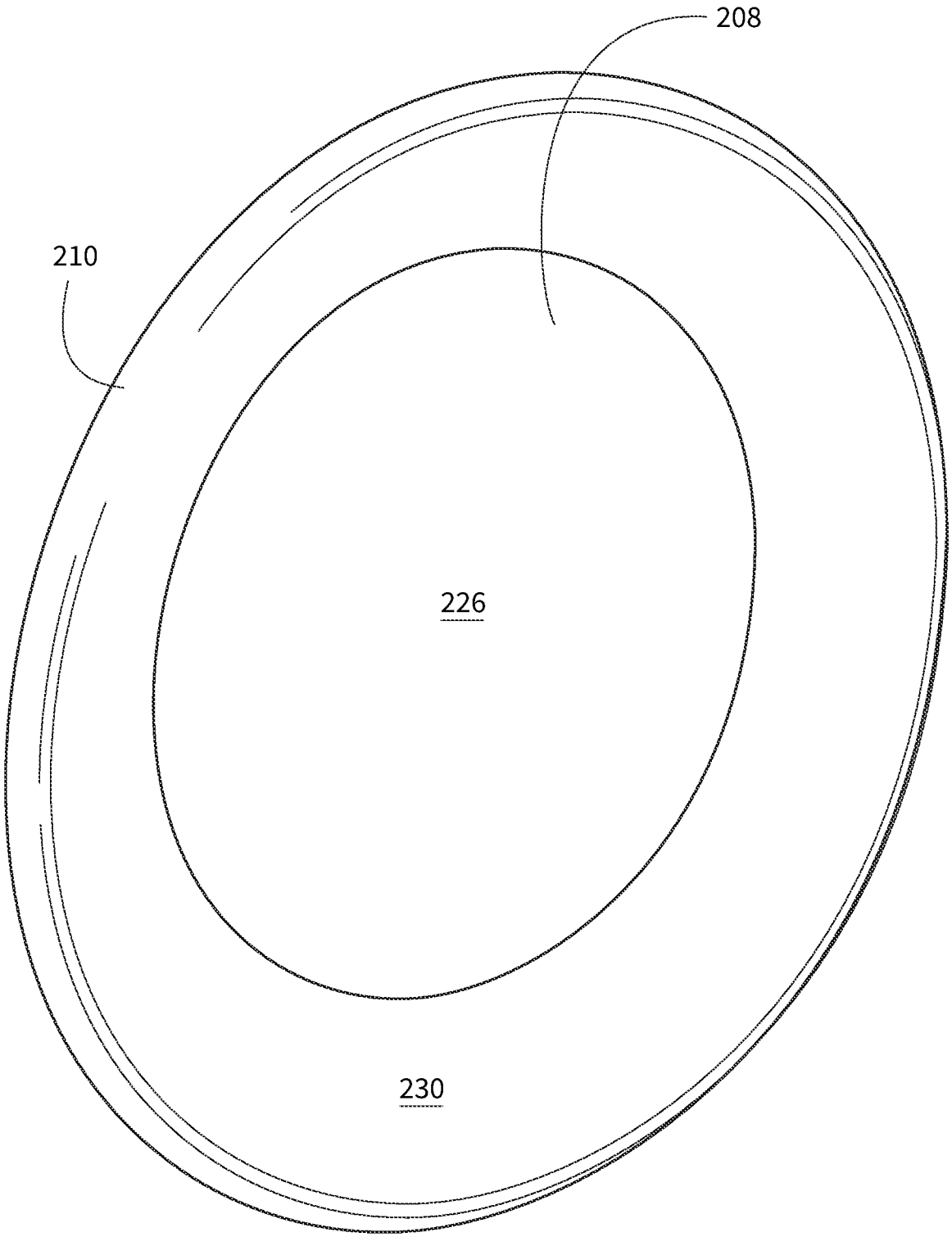
FIG. 6 provides a perspective view of a shield and a trim ring of the door assembly of FIG. 4.

In some embodiments, e.g., as illustrated in FIG. 6, the shield 208 may fit within the trim ring 210, whereby the trim ring 210 surrounds and encloses the shield 208, such as an outer circumference 222 (FIG. 8) of the shield 208. The trim ring 210 may also bridge a radial gap between the outer circumference 222 of the shield 208 and an outer circumference of the frame 202, whereby the trim ring 210 provides or contributes to a more seamless appearance to the door assembly 200.

Figure 7:
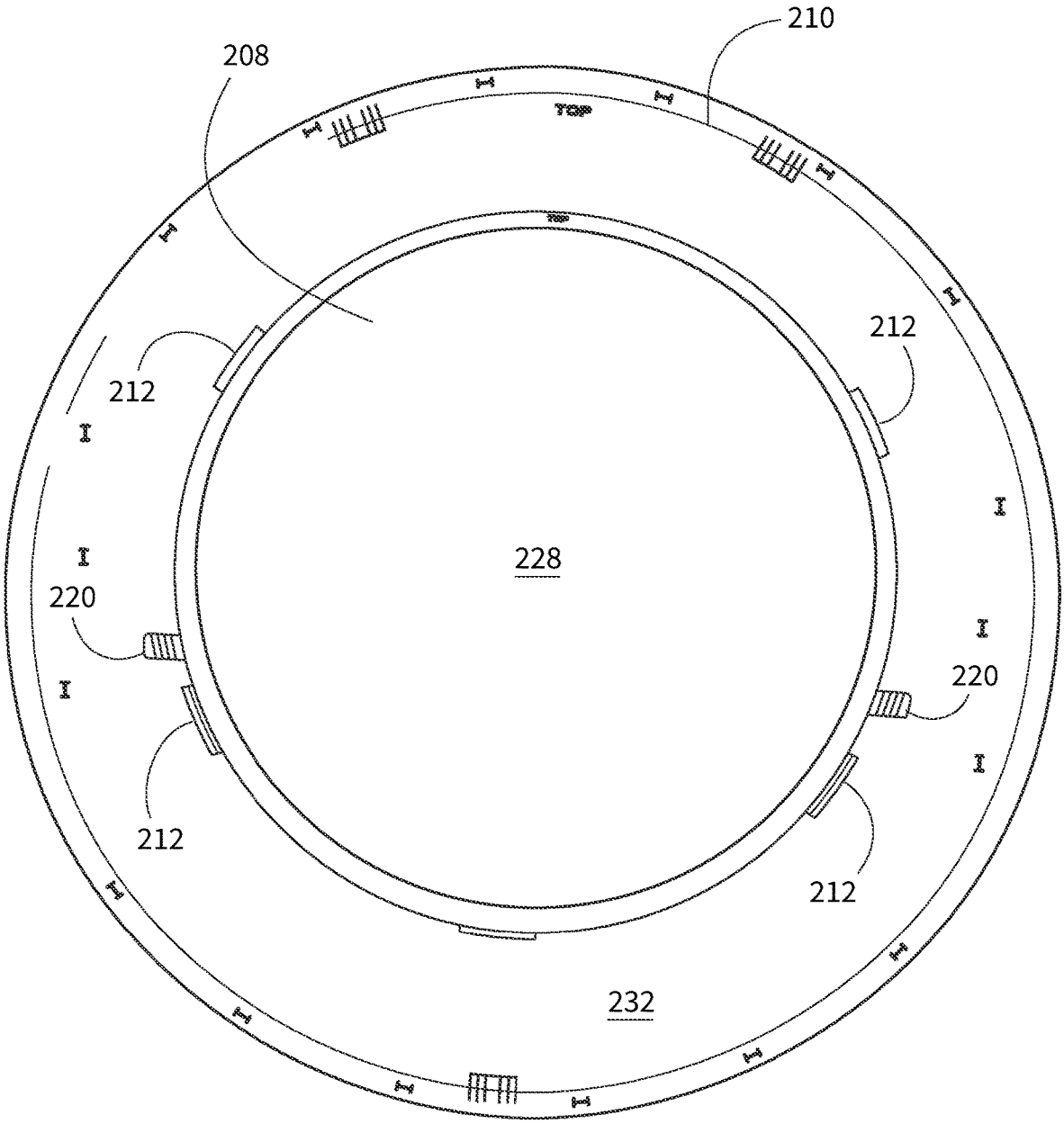
FIG. 7 provides a back, interior view of the shield and the trim ring of the door assembly of FIG. 4.
Figure 8:
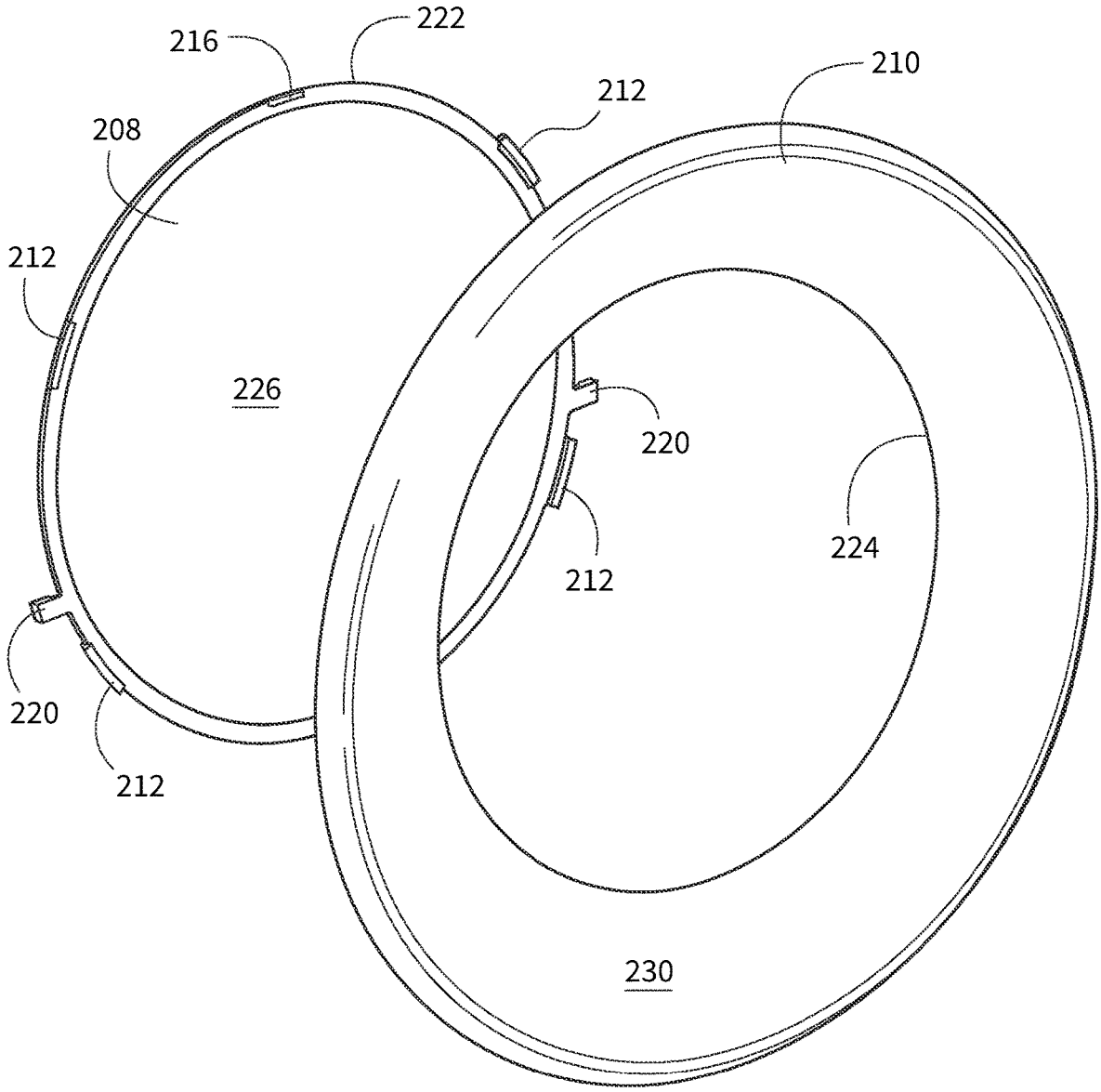
FIG. 8 provides an exploded perspective view of the shield and the trim ring of the door assembly of FIG. 4.

FIG. 7 provides a rear or inner side view, e.g., as would be seen looking out from the window 204 in the door assembly 200 and away from the interior of the laundry appliance, of the shield 208 and the trim ring 210 in a connected, e.g., coupled or fully engaged, position. FIG. 8 provides an exploded perspective view of the shield 208 and trim ring 210, e.g., where the shield 208 and trim ring 210 are not coupled and are spaced apart, as seen generally from a front or outer side, e.g., where the shield 208 and trim ring 210 are positioned relative to each other in the same order as they would be when coupled, and are viewed in FIG. 8 facing a front side or outer side of the door assembly 200.

As may be seen, e.g., in FIGS. 7 and 8, the shield 208 comprises a front or outer surface 226 and an opposing back or inner surface 228 and the trim ring 210 comprises a front or outer surface 230 and an opposing back or inner surface 232. It should be understood that the door assembly 200 may also be used in a lid, e.g., a door in a top surface of a laundry appliance, where the "front" in such embodiments may also be referred to as "top" or "upper" and "back" in such embodiments may also be referred to as "bottom" or "lower," such that the description herein of a door assembly for a front-load laundry appliance is by way of example only and the possible orientations of the door assembly are not intended to be limited. Further, "inner" and "outer" are used herein with respect to an interior of the laundry appliance, such as a center of the laundry appliance, e.g., such that "inner" refers to closer to the interior and/or the center thereof while "outer" refers to a position that is away from the interior and/or the center thereof.

In particular, the inner surface 228 of the shield 208 and the inner surface 232 of the trim ring 210 may be seen in FIG. 7, while the outer surface 226 of the shield 208 and the outer surface 230 of the trim ring 210 may be seen in FIG. 8. In some embodiments, the shield 208 and the trim ring 210 may be coupled together by mutual engagement of one or more first locking tabs 212 on the shield 208 with one or more second locking tabs 214 on the trim ring 210. In some embodiments, multiple first locking tabs 212, such as a first plurality of locking tabs 212, e.g., four locking tabs 212 and multiple second locking tabs 214, such as a second plurality of locking tabs 214, e.g., four locking tabs 214, may be provided. The one or more first locking tabs 212 and the one or more second locking tabs 214 may each be circumferential, e.g., may be oriented along a circumference of the shield 208 and the trim ring 210, respectively. The first plurality of locking tabs 212 and the second plurality of locking tabs 214 may be oppositely oriented, e.g., each locking tab 212 of the first plurality of locking tabs 212 may be oriented in a first direction and each locking tab 214 of the second plurality of locking tabs 214 may be oriented in a second direction opposite the first direction. As will be described further below, each locking tab 212 or 214 may include a ramp surface 238 or 248, and the ramp surface 238 of each locking tab 212 of the first plurality of locking tabs 212 may face the first direction, whereas the ramp surface 248 of each locking tab 214 of the second plurality of locking tabs 214 may face the second direction, opposite the first direction.

The first plurality of locking tabs 212 may each project outward, e.g., forward, from the shield 208, such as towards the trim ring 210 when the shield 208 is position inboard of the trim ring 210, such as when the shield 208 and the trim ring 210 are coupled together. Thus, for example, in the configuration illustrated in FIG. 7, the second plurality of locking tabs 214 are not visible because they are occluded by the first plurality of locking tabs 212, e.g., the second plurality of locking tabs 214 are each positioned axially outward, e.g., in front, of a corresponding one of the first plurality of locking tabs 212 and are each fully overlapped by the corresponding first locking tab 212 along the circumferential direction C.

As may be seen in FIG. 8 in particular, the first plurality of locking tabs 212 may be spaced around an outer circumference 222 of the shield 208. As mentioned, the first plurality of locking tabs 212 may be circumferential, e.g., each locking tab 212 of the first plurality of locking tabs 212 may be oriented along the outer circumference 222 of the shield 208, such as with a largest dimension of each first locking tab 212 oriented generally along the outer circumference 222 of the shield 208 and/or generally along the circumferential direction C.

Also as may be seen in FIGS. 7 and 8, the door assembly 200 may further include one or more locking lugs 220 on the outer circumference 222 of the shield 208. For example, two locking lugs 220 may be provided opposite each other on the shield 208, as illustrated in FIGS. 7 and 8. The locking lug 220 or each locking lug 220 may extend outward, e.g., away from a center of the shield 208, from the outer circumference 222 of the shield 208. The locking lug 220 or each locking lug 220 may extend generally along or parallel to one of the above-mentioned coordinate directions, such as generally along the lateral direction L, e.g., in front-load embodiments such as the illustrated embodiment. The locking lug 220 or each locking lug 220 may be configured to engage the frame 202 of the door assembly 200 when the shield 208 and the trim ring 210 are mounted on the frame 202, such as the locking lug 220 or each locking lug 220 may be received in a corresponding groove or recess (not shown) in the frame 202, e.g., to promote and maintain consistent alignment of the shield 208 and trim ring 210 with the frame 202. For example, the locking lugs 220 may constrain the shield 208 against rotation about the axial direction A. The shield 220 may also be constrained against translation along the axial direction A (e.g., linear movement in and out or backwards and forwards) by a tight fit between the frame 202 and the trim ring 210 when the door assembly 200 is fully assembled.

Figure 9:
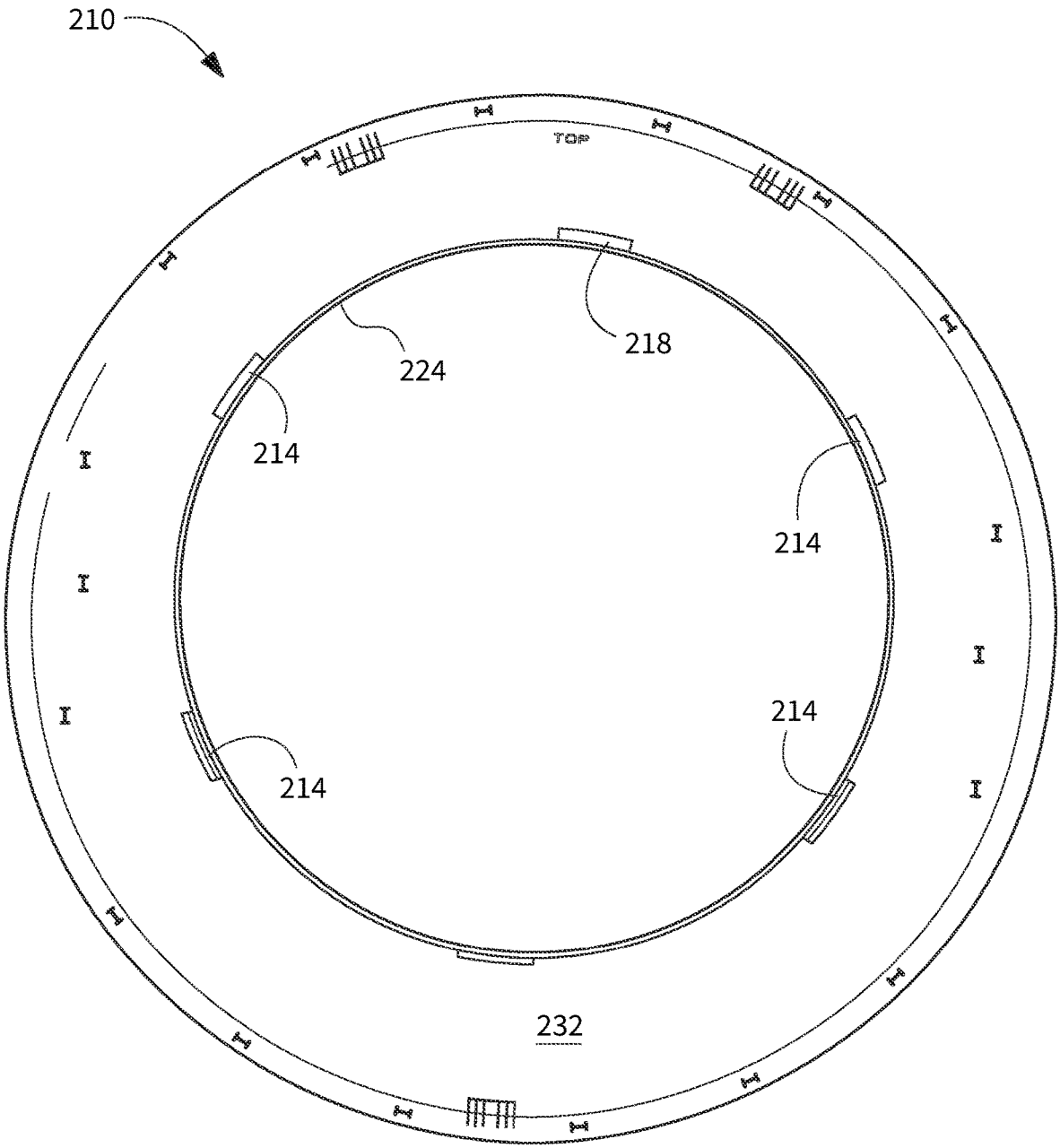
FIG. 9 provides a back, interior view of the trim ring of the door assembly of FIG. 4.

FIG. 9 provides an inner view of the trim ring 210 in isolation, e.g., without the shield 208. Thus, the second plurality of locking tabs 214 may be seen in FIG. 9. In some embodiments, the second plurality of locking tabs 214 may be spaced around an inner circumference 224 of the trim ring 210. Also, as may be seen in FIGS. 8 and 9, and as will be described in further detail below with respect to FIG. 15, the door assembly 200 may further include a first stop block 216 on the shield 208 and a second stop block 218 on the trim ring 210. In some embodiments, e.g., as illustrated in FIG. 9, each locking tab 214 of the second plurality of locking tabs 214 may extend outward along the radial direction R from the inner circumference 224 of the trim ring 210.

Figure 10:
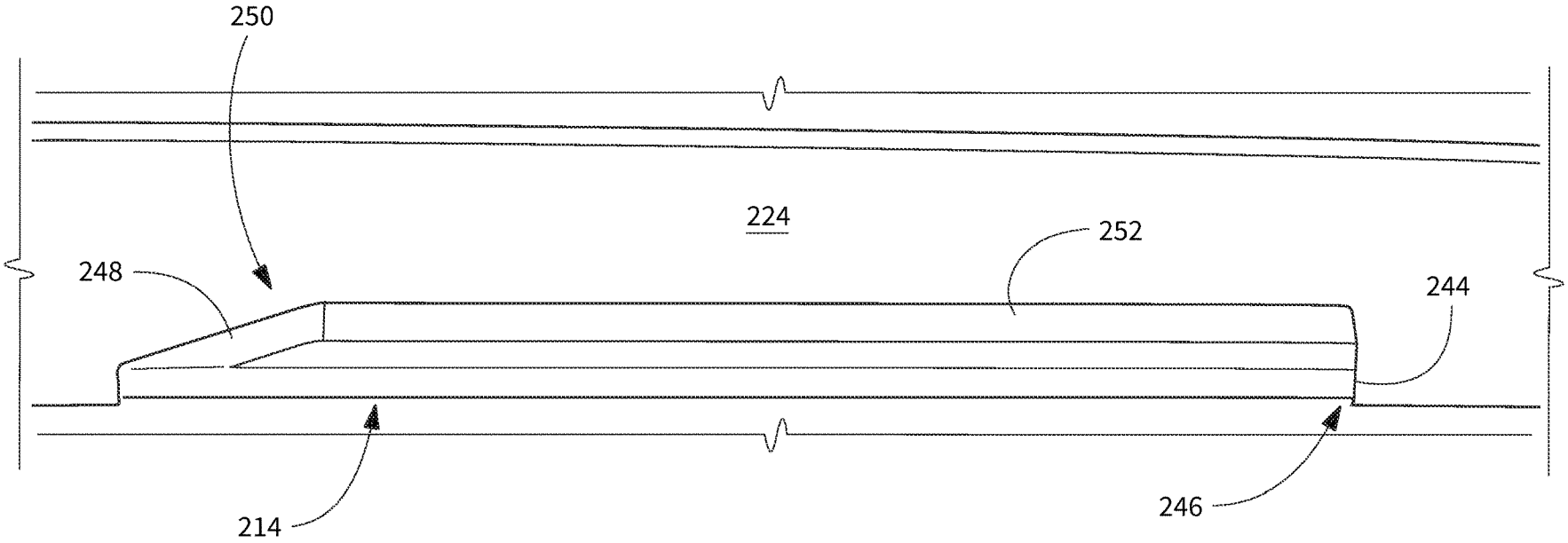
FIG. 10 provides an enlarged view of a locking tab of the trim ring of the door assembly of FIG. 4.

FIG. 10 provides an enlarged view of a locking tab 214, e.g., one of the second plurality of locking tabs 214 on the trim ring 210. Each tab 214 projects radially outward from the inner circumference 224 of the trim ring 210, and the view of FIG. 10 is looking radially inward towards the inner circumference 224 of the trim ring 210. In some embodiments, e.g., as illustrated in FIG. 10, each locking tab 214 of the second plurality of locking tabs 214 may include a flat surface 244 on an aft side 246 of the locking tab 214 and a ramp surface 248 on a forward side 250 of the locking tab 214. The aft side 246 and the forward side 250 may be positioned at opposite ends of the locking tab 214 along the circumferential direction C. The ramp surface 248 may be oriented oblique to the flat surface 244 and/or oblique to the circumferential direction C. The locking tab 214 may further include a friction plane surface 252 adjoining the ramp surface 248 on the forward side 250 of the locking tab 214.

Figure 11:
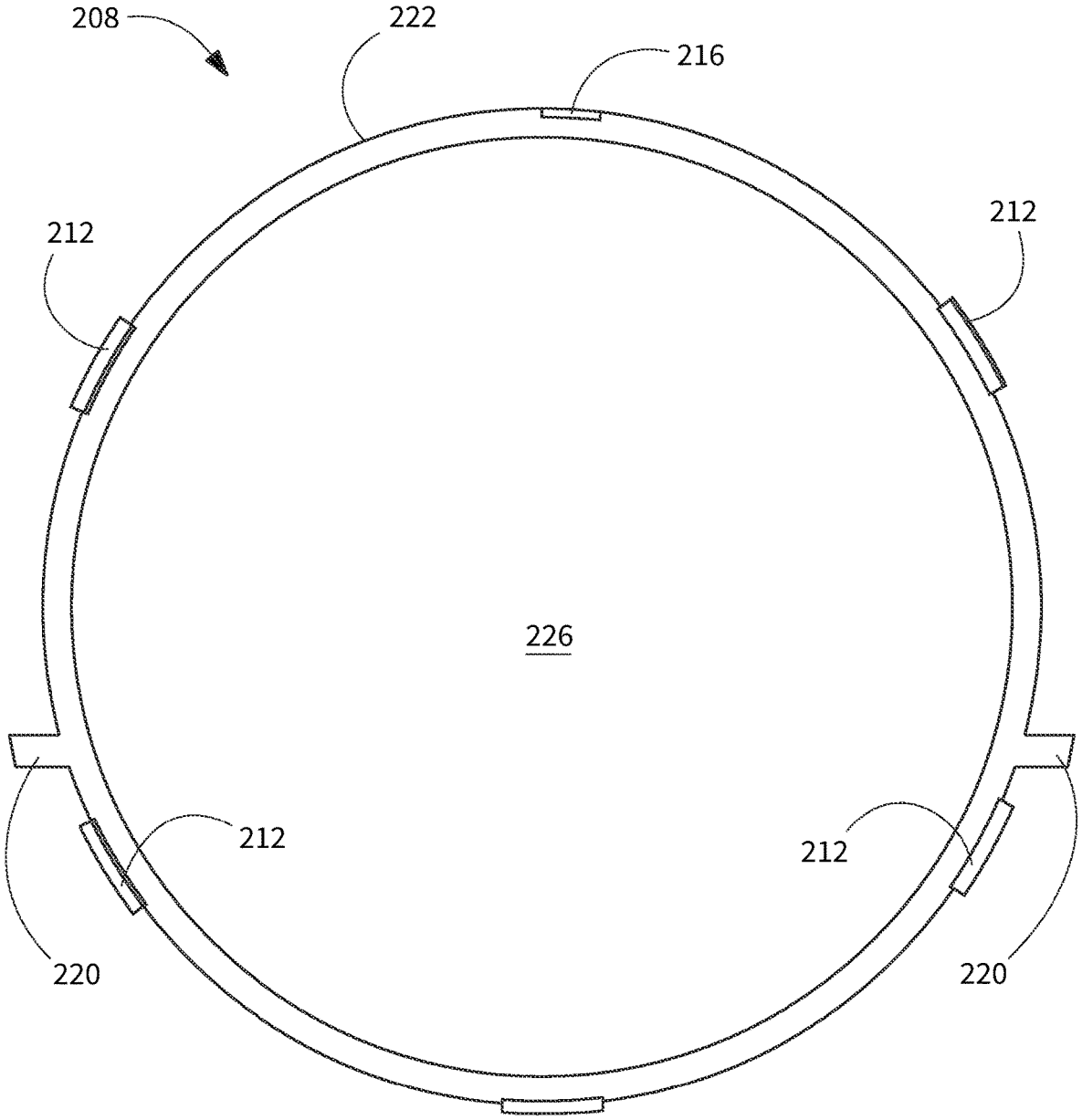
FIG. 11 provides a front, outer side view of the shield of the door assembly of FIG. 4.
Figure 12:
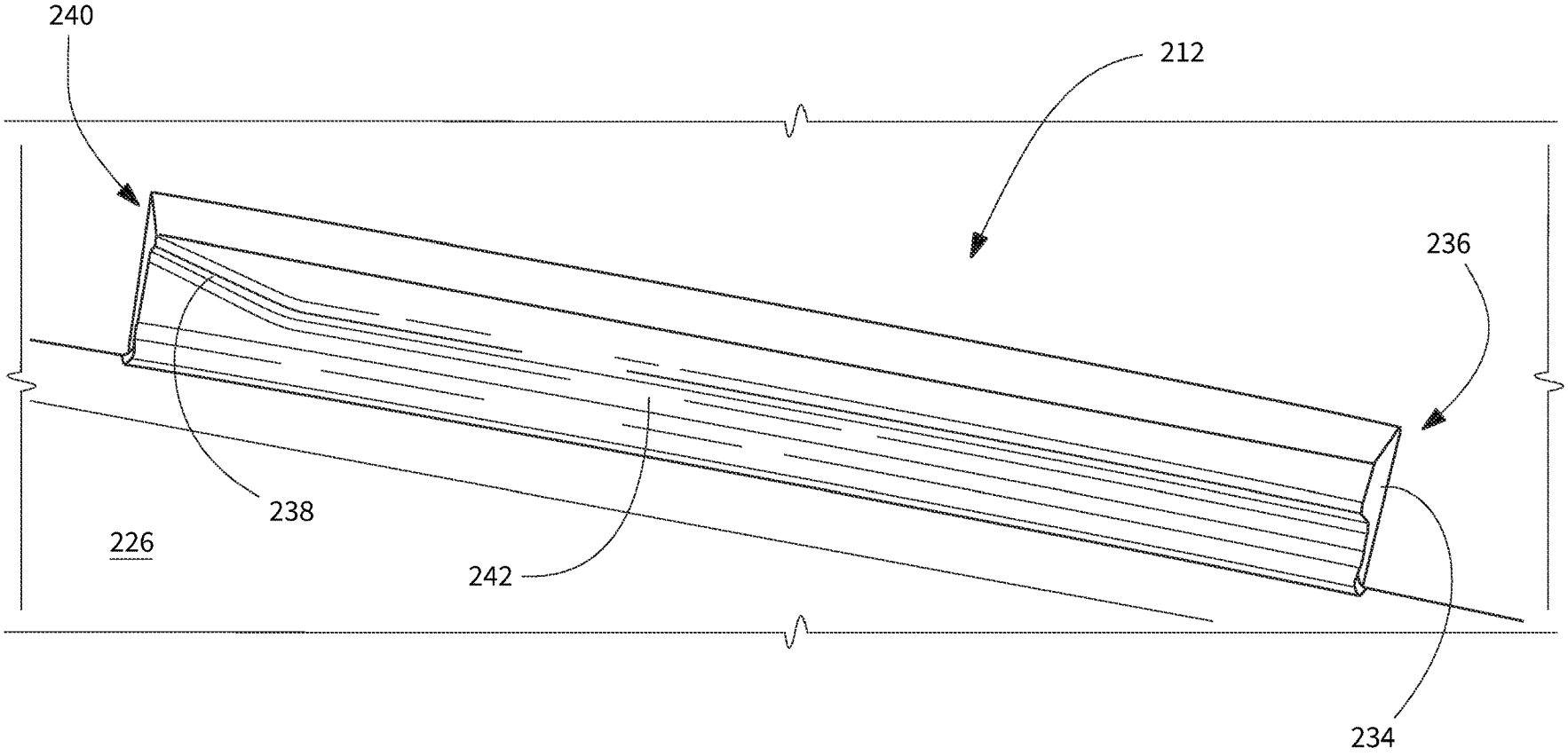
FIG. 12 provides an enlarged view of a locking tab of the shield of the door assembly of FIG. 4.

FIG. 11 provides a front view of the shield 208, e.g., looking inward along the axial direction A at the shield 208. FIG. 12 provides an enlarged view of a locking tab 212, e.g., one of the first plurality of locking tabs 212 on the shield 208. Each tab 212 projects radially inward and the view of FIG. 12 is looking radially outward towards the outer circumference 222 of the shield 208. In some embodiments, e.g., as illustrated in FIG. 12, each locking tab 212 of the first plurality of locking tabs 212 may include a flat surface 234 and a ramp surface 238. The first locking tabs 212 and the second locking tabs 214 may be oppositely oriented and, in some embodiments, may be mirrored. For example, each first locking tab 212 may extend between a forward side 236 and an aft side 240, similar to the second locking tabs 214 described above, where the directions forward and/or aft may be clockwise or counterclockwise along the circumferential direction C. Where each second locking tab 214 includes the ramp surface 248 thereof at the forward side 250 and the first locking tabs 212 are oppositely oriented, the ramp surface 238 of each first locking tab 212 of the first plurality of locking tabs 212 may be positioned at an aft side 240 of each first locking tab 212 and the flat surface 234 of each locking tab 212 of the plurality of first locking tabs 212 may be positioned on a forward side 236 of the locking tab 212. The ramp surface 238 of each locking tab 212 of the first plurality of locking tabs 212 may be oblique to the flat surface 234 and/or to the circumferential direction C. Each locking tab 212 of the first plurality of locking tabs 212 may further includes a friction plane surface 242 adjoining the ramp surface 238 at the aft side 240 of the locking tab 212.

In various embodiments, the ramp surfaces 238 and 248 may each define an oblique angle with respect to the circumferential direction C. For example, the angle of either or both ramp surfaces 238 and 248 may be between about fifteen degrees and about sixty degrees, such as between about twenty-five degrees and about fifty degrees, such as about thirty degrees or about forty-five degrees. In various embodiments, the angle of the ramp surface 238 of the first locking tab 212 (or each locking tab 212 of the first plurality of locking tabs 212) with respect to the circumferential direction C may have the same magnitude as the angle of the ramp surface 248 of the second locking tab 214 (or each locking tab 214 of the second plurality of locking tabs 214) with respect to the circumferential direction C. In some embodiments, the ramp surfaces 238 and 248 may define the same angles in opposite orientations, e.g., the ramp surfaces 238 and 248 may be mirrored, such as with one ramp surface 238 or 248 tapering outward along the radial direction R and the other ramp surface 238 or 248 tapering inward along the radial direction R, where radially outward refers to away from the central axis (which defines axial direction A) and inward refers to towards the central axis.

The trim ring 210 and the shield 208 may be coupled together via mutual engagement of the first plurality of locking tabs 212 and the second plurality of locking tabs 214. For example, the shield 208 and trim ring 210 may be rotated into such engagement, such as from a starting position wherein each locking tab 212 of the first plurality of locking tabs 212 is placed end-to-end with a corresponding one locking tab 214 of the second plurality of locking tabs 214 to a coupled position or fully engaged position wherein the friction surfaces 242 and 252 of each pair of locking tabs 212 and 214 are abutting and overlapping each other in order to hold the shield 208 and the trim ring 210 in mutual engagement, e.g., by frictional resistance to counter rotation along and between the friction surfaces 242 and 252. In the starting position, each locking tab 212 of the first plurality of locking tabs 212 may be end-to-end with a corresponding one locking tab 214 of the second plurality of locking tabs 214 such that the aft side 240 of the first locking tab 212 is adjacent to and/or in contact with the forward side 250 of the second locking tab 214. In some embodiments, e.g., where the locking tabs 212 and 214 are mirrored, the ramp surfaces 238 and 248 may be parallel and/or colinear when in the starting position. From the starting position to the coupled position, one of the shield 208 and the trim ring 210 may be rotated along the circumferential direction C relative to the other of the shield 208 and the trim ring 210, or both of the shield 208 and the trim ring 210 may be rotated simultaneously in opposite directions, such that the ramp surface 238 of the first locking tab 212 approaches the flat surface 244 of the second locking tab 214 and the ramp surface 248 of the second locking tab 214 approaches the flat surface 234 of the first locking tab 212. The degree of rotation from the starting position to the coupled position may be between about five degrees and about twenty degrees, such as about ten degrees or about twelve degrees, etc.

Figure 15:
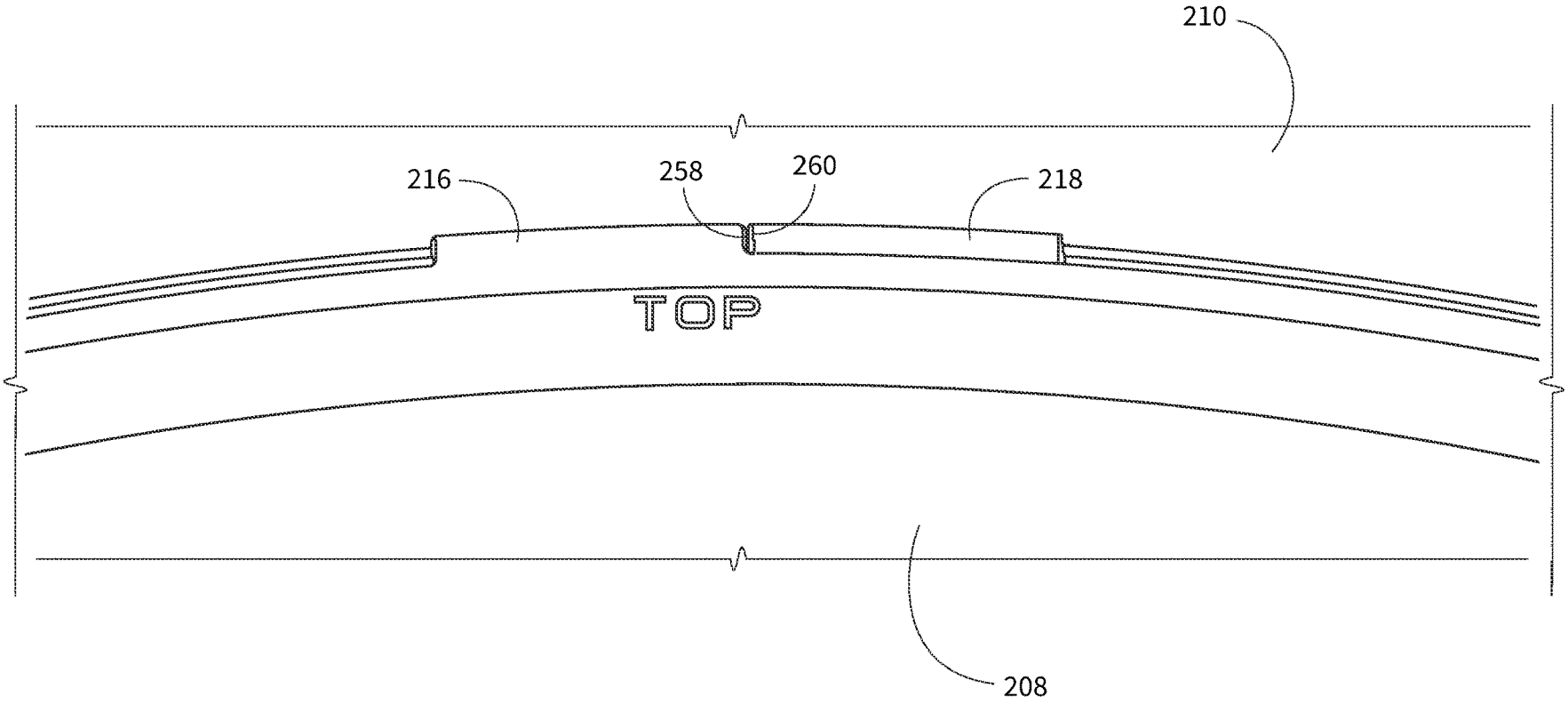
FIG. 15 provides an enlarged perspective view of additional portions of the shield and the trim ring of the door assembly of FIG. 4.

As may be seen, e.g., in FIG. 15, the door assembly may also include a first stop block 216 having a flat surface 258 and a second stop block 218 having an opposing flat surface 260. For example, the first stop block 216 may be provided on the shield 208 and the second stop block 218 may be provided on the trim ring 210. When the shield 208 and/or trim ring 210 rotate to the coupled position, e.g., as described above, the first and second stop blocks 216 and 218 may provide a limit stop to such rotation, e.g., when the opposing flat surfaces 258 and 260 thereof come into abutment, the shield 208 and trim ring 210 may be prevented from further rotation about the axial direction A in a first direction, and counter rotation (e.g., away from the fully engaged position and/or towards the starting position) of the shield 208 and trim ring 210 may be prevented by the locking lugs 220 and frame 202, as described above.

Figure 13:
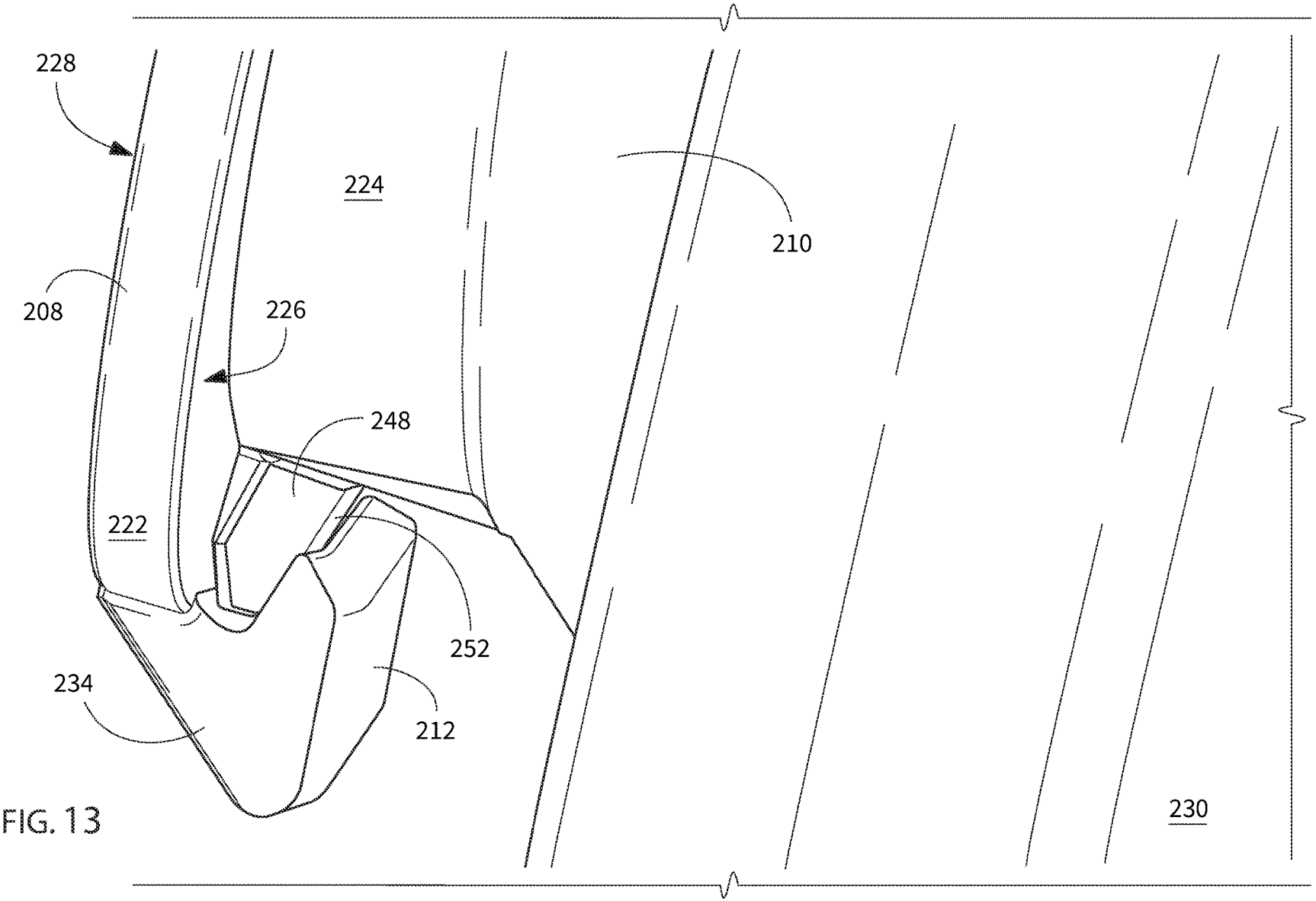
FIG. 13 provides an enlarged perspective view of portions of the shield and the trim ring of the door assembly of FIG. 4.
Figure 14:
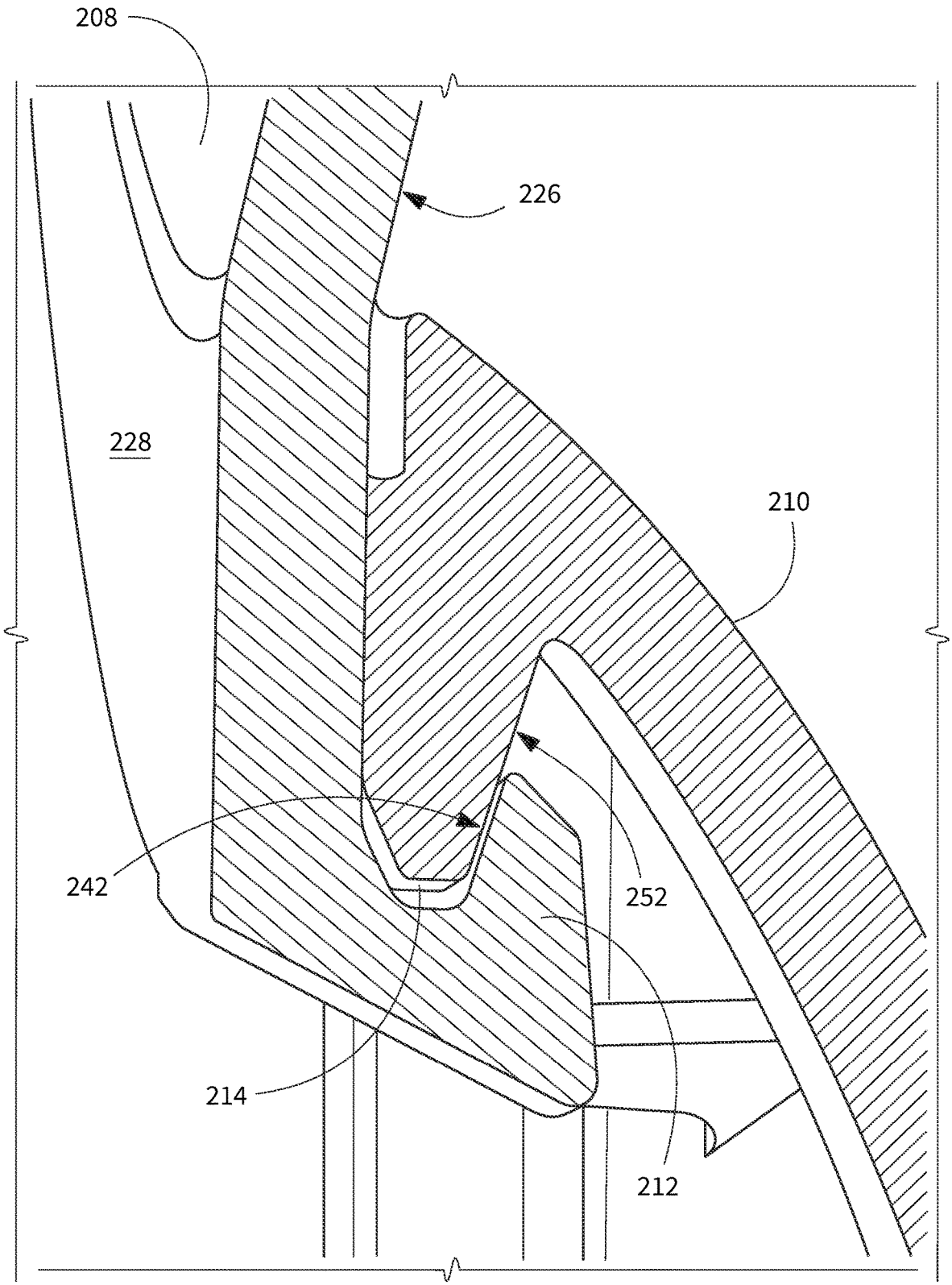
FIG. 14 provides a section view of portions of the shield and the trim ring of the door assembly of FIG. 4.

In FIGS. 13, 14, and 15, the shield 208 and the trim ring 210 are illustrated in the coupled position, e.g., fully engaged position. As noted above, FIG. 15 illustrates the stop blocks 216 and 218 in the coupled position. FIGS. 13 and 14 provide views of the first locking tab 212 and the second locking tab 214, e.g., one of the first plurality of locking tabs 212 and a corresponding one of the second plurality of locking tabs 214, in the coupled position. In particular, the ramp surface 248 of the second locking tab 214 adjacent the flat surface 234 of the first locking tab 212 while in the coupled position may be seen in FIG. 13. Further, the mutual abutment of friction surfaces 242 and 252 may be seen in FIGS. 13 and 14.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A laundry appliance, comprising:
- a cabinet defining an opening;
- a vessel mounted within the cabinet, the vessel accessible through the opening; and
- a door assembly rotatably mounted to the cabinet at the opening, the door assembly rotatable between a closed position wherein the vessel is enclosed within the cabinet and an open position permitting access to the vessel through the opening, the door assembly comprising:
  - a frame;
  - a window in the frame;
  - a shield outbound of the window, the shield comprising a first plurality of locking tabs spaced around an outer circumference of the shield; and
  - a trim ring surrounding the shield, the trim ring comprising a second plurality of locking tabs spaced around an inner circumference of the trim ring, the shield and the trim ring coupled together by mutual engagement of the first plurality of locking tabs and the second plurality of locking tabs.

2. The laundry appliance of claim 1, further comprising a first stop block on the shield and a second stop block on the trim ring, wherein the shield and the trim ring are held in a fully engaged position by abutment of the first stop block and the second stop block.

3. The laundry appliance of claim 1, wherein each locking tab of the first plurality of locking tabs is mirrored with a corresponding locking tab of the second plurality of locking tabs.

4. The laundry appliance of claim 1, further comprising a locking lug on the outer circumference of the shield, the locking lug configured to engage the frame when the shield and the trim ring are mounted on the frame.

5. The laundry appliance of claim 1, wherein each locking tab of the first plurality of locking tabs is oriented in a first direction and each locking tab of the second plurality of locking tabs is oriented in a second direction opposite the first direction.

6. The laundry appliance of claim 1, wherein each locking tab of the first plurality of locking tabs comprises a flat surface on a forward side of the locking tab, a ramp surface on an aft side of the locking tab oblique to the flat surface, and a friction plane surface adjoining the ramp surface on the aft side of the locking tab.

7. The laundry appliance of claim 6, wherein the ramp surface of each locking tab of the first plurality of locking tabs defines an angle of about thirty degrees with the flat surface of the locking tab.

8. The laundry appliance of claim 1, wherein each locking tab of the second plurality of locking tabs comprises a flat surface on an aft side of the locking tab, a ramp surface on a forward side of the locking tab oblique to the flat surface, and a friction plane surface adjoining the ramp surface on the forward side of the locking tab.

9. The laundry appliance of claim 8, wherein the ramp surface of each locking tab of the second plurality of locking tabs defines an angle of about thirty degrees with the flat surface of the locking tab.

10. A laundry appliance, comprising:
- a cabinet defining an opening;
- a vessel mounted within the cabinet, the vessel accessible through the opening; and
- a door assembly rotatably mounted to the cabinet at the opening, the door assembly rotatable between a closed position wherein the vessel is enclosed within the cabinet and an open position permitting access to the vessel through the opening, the door assembly comprising:
  - a frame;
  - a window in the frame;
  - a shield outbound of the window, the shield comprising a first circumferential locking tab; and
  - a trim ring surrounding the shield, the trim ring comprising a second circumferential locking tab, the shield and the trim ring coupled together by mutual engagement of the first circumferential locking tab and the second circumferential locking tab.

11. The laundry appliance of claim 10, further comprising a first stop block on the shield and a second stop block on the trim ring, wherein the shield and the trim ring are held in a fully engaged position by abutment of the first stop block and the second stop block.

12. The laundry appliance of claim 10, wherein the first circumferential locking tab is mirrored with the second circumferential locking tab.

13. The laundry appliance of claim 10, further comprising a locking lug on an outer circumference of the shield, the locking lug configured to engage the frame when the shield and the trim ring are mounted on the frame.

14. The laundry appliance of claim 10, wherein the first circumferential locking tab is oriented in a first direction and the second circumferential locking tab is oriented in a second direction opposite the first direction.

15. The laundry appliance of claim 10, wherein the first circumferential locking tab comprises a flat surface on a forward side of the first circumferential locking tab, a ramp surface on an aft side of the first circumferential locking tab oblique to the flat surface, and a friction plane surface adjoining the ramp surface on the aft side of the first circumferential locking tab.

16. The laundry appliance of claim 15, wherein the ramp surface defines an angle of about thirty degrees with the flat surface.

17. The laundry appliance of claim 10, wherein the second circumferential locking tab comprises a flat surface on an aft side of the second circumferential locking tab, a ramp surface on a forward side of the second circumferential locking tab oblique to the flat surface, and a friction plane surface adjoining the ramp surface on the forward side of the second circumferential locking tab.

18. The laundry appliance of claim 17, wherein the ramp surface defines an angle of about thirty degrees with the flat surface.

* * * * *